US009815076B2

(12) United States Patent
Schulz et al.

(10) Patent No.: US 9,815,076 B2
(45) Date of Patent: Nov. 14, 2017

(54) VENTED CONTAINER ASSEMBLY

(71) Applicant: 3M INNOVATIVE PROPERTIES COMPANY, St. Paul, MN (US)

(72) Inventors: Mark F. Schulz, Lake Elmo, MN (US); Claudia M. Mulvaney, Woodbury, MN (US); Stephen C. P. Joseph, Woodbury, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 0 days.

(21) Appl. No.: 14/779,779

(22) PCT Filed: Mar. 28, 2014

(86) PCT No.: PCT/US2014/032143

§ 371 (c)(1),
(2) Date: Sep. 24, 2015

(87) PCT Pub. No.: WO2014/160922

PCT Pub. Date: Oct. 2, 2014

(65) Prior Publication Data

US 2016/0052002 A1 Feb. 25, 2016

Related U.S. Application Data

(60) Provisional application No. 61/806,600, filed on Mar. 29, 2013.

(51) Int. Cl.
*B05B 7/30* (2006.01)
*B05B 7/24* (2006.01)
(Continued)

(52) U.S. Cl.
CPC ..... *B05B 7/2478* (2013.01); *B05B 7/241* (2013.01); *B05B 7/2408* (2013.01); *B65D 47/32* (2013.01); *B65D 51/1661* (2013.01)

(58) Field of Classification Search
CPC ... B05B 7/2405; B05B 7/2408; B05B 7/2467; B05B 7/247; B05B 7/2478; B05B 7/241; B65D 51/1661; B65D 47/32
(Continued)

(56) References Cited

U.S. PATENT DOCUMENTS 6,820,824 B1 11/2004 Joseph
8,727,151 B2 5/2014 Valles et al.
(Continued)

FOREIGN PATENT DOCUMENTS

WO WO 2011/047876 4/2011
WO WO 2014/018710 1/2014

OTHER PUBLICATIONS

International Search Report for PCT International Application No. PCT/US2014/032143 dated Jun. 24, 2014, 4 pages.

*Primary Examiner* — Christopher Kim
(74) *Attorney, Agent, or Firm* — Aleksander Medved

(57) ABSTRACT

Container assemblies (100) that transition between a sealing state and a retained venting state are described. The container assemblies each include a body portion (110) having an open end (113), and a lid portion (120) adapted to cover the open end of the body portion to create an enclosed volume, e.g. reservoir, and additionally comprise a venting feature (140). When the fluid pressure within the enclosed volume is less than a threshold pressure, the lid portion is in a sealing state such that the lid portion and the body portion cooperate to maintain a substantially fluid-tight seal against fluid leaving the enclosed volume. When the fluid pressure is greater than or equal to the threshold pressure, the lid portion is in a retained venting state such that the excess fluid pressure from the enclosed volume vents through the venting feature while retaining the lid portion on the body portion.

23 Claims, 9 Drawing Sheets

(51) Int. Cl.
*B65D 51/16* (2006.01)
*B65D 47/32* (2006.01)

(58) Field of Classification Search
USPC ..... 239/345, 347
See application file for complete search history.

(56) References Cited

U.S. PATENT DOCUMENTS

| | | | | |
|---|---|---|---|---|
| 2002/0134861 | A1* | 9/2002 | Petrie | B05B 7/2408 239/345 |
| 2010/0072164 | A1 | 3/2010 | Smith | |
| 2012/0291890 | A1 | 11/2012 | Pan | |

* cited by examiner

VENTED CONTAINER ASSEMBLY

CROSS REFERENCE TO RELATED APPLICATIONS

This application is a national stage filing under 35 U.S.C. 371 of PCT/US2014/032143, filed Mar. 28, 2014, which claims priority to U.S. Provisional Application No. 61/806,600, filed Mar. 29, 2013, the disclosures of which are incorporated by reference in their entireties herein.

Container assemblies that provide a substantially fluid-tight seal and allow venting of excess internal fluid pressure are disclosed herein.

Liquids and other fluids, such as unused paint or other mixes, are often stored in containers for later use of the stored liquid. Containers for storing the fluids may require a fluid-tight seal in order to prevent drying, concentration, or contamination of the fluid, which might otherwise render the fluid unusable.

One potential problem with sealed containers is, in some storage conditions, such as high temperatures, the fluid-tight seal may permit fluid pressure to build up inside the container. When the fluid pressure is high enough, the container seal can become compromised as the fluid pressure releases. However, once the seal is compromised, it does not return to a sealed configuration, even after the fluid pressure has released. This can cause drying, concentration, or contamination of the stored fluid, thereby rendering it unusable. Additionally, where containers comprise a lid that participates in the fluid-tight seal, the lid may become completely removed from the container when the seal is compromised to release the built-up fluid pressure. In some cases, the lid may remain on top of the container, but with a compromised connection such that the lid may detach when the container is later picked up by a user or otherwise placed into use. In some cases, loss of the lid can result in spills and other accidents.

Some containers that have a threaded portion for screwing a lid onto the container may be resistant to loss of the lid or may even be resistant to compromise of the seal when the internal vapor pressure increases during storage. However, because of pressure build-up inside such threaded containers without venting, the containers may rupture or burst during storage, or even when placed into use, causing loss of the stored fluid, as well as other hazards. Furthermore, threaded containers and other sealed containers where unvented pressure builds up inside the containers during storage, but does not release through venting or other compromise of the seal may be subject to bursting or spraying and loss of the contents upon opening of the seal. Moreover, parts using threaded interfaces may require more material to manufacture, and may require additional effort to assemble and disassemble as compared to non-threaded designs.

Another consideration in the design of sealing containers is the force required to remove a lid once it has been attached to a container. Where users may desire this option, the force to remove should ideally be manageable by hand (e.g. without the use of tools) for the average user. Failure to make this accommodation could result in user frustration, injuries, spills, and other hazards.

Thus, there is a need for container assemblies that address these problems.

SUMMARY

Container assemblies described herein transition between a sealing state and a retained venting state. The container assemblies may include a body portion having an open end, and a lid portion adapted to cover the open end of the body portion to create an enclosed volume, e.g. reservoir. The body portion can comprise an open end, a body portion sidewall, and a first retainer disposed on the body portion sidewall. The lid portion can comprise a lid portion sidewall and a second retainer disposed on the lid portion sidewall and adapted to cooperate with the first retainer to retain the lid portion on the body portion. At least one of the first retainer and the second retainer can comprise a venting feature.

When the fluid pressure within the enclosed volume is less than a threshold pressure, at least one of the body portion and the lid portion is in a sealing state such that the lid portion and the body portion cooperate to maintain a substantially fluid-tight seal against fluid leaving the enclosed volume. When the fluid pressure is greater than or equal to the threshold pressure, the container assembly is in a retained venting state such that the excess fluid pressure from the enclosed volume vents through the venting feature while retaining the lid portion on the body portion.

In one or more embodiments, the container assemblies can additionally comprise a protrusion disposed on at least one of the body portion or the lid portion.

In one or more embodiments, the fluid-tight seal is formed by cooperation between at least two of the body portion sidewall, the first retainer, the lid portion sidewall, the second retainer, the protrusion, or combinations thereof.

In one or more embodiments, the second retainer is adapted to bear against the first retainer.

In one or more embodiments, the venting feature comprises at least one interruption in the first retainer, the second retainer, or a combination thereof.

In one or more embodiments, the first retainer is disposed proximate the open end of the body portion.

In one or more embodiments, the open end of the body portion surrounds a container axis, and wherein movement of the lid portion from the closed position to the open position is along the container axis.

In one or more embodiments, the first retainer comprises a first retaining surface and the first retaining surface is disposed at a first angle with respect to the body portion sidewall. The second retainer comprises a second retaining surface, and the second retaining surface is disposed at a second angle with respect to the lid portion sidewall. The first angle is in a range from 1 degrees to 90 degrees from the body portion sidewall. When the fluid pressure is greater than or equal to the threshold pressure, the second retaining surface is repositionable with respect to the first retaining surface.

In one or more embodiments, when the fluid pressure is greater than or equal to the threshold pressure, the lid portion sidewall is repositionable with respect to the body portion sidewall.

In one or more embodiments, the venting feature comprises a porous material.

In one or more embodiments, the venting feature comprises a plurality of venting members. The plurality of venting members comprises notches, grooves, indentations, incisions, holes, apertures, textured surfaces, porous materials, or combinations thereof. The plurality of venting members may be spaced substantially evenly about the first retainer, second retainer, or combinations thereof.

In one or more embodiments, the open end of the body portion is elliptical and comprises an open end circumference. The plurality of venting members may be spaced in a substantially equidistant manner around the open end circumference.

In one or more embodiments, the body portion comprises a plastic material.

In one or more embodiments, the lid portion has an outlet for transferring fluid contained in the enclosed volume out of the container assembly. The lid portion may comprise an outlet closure member for sealing the outlet. The outlet closure member may comprise a porous material.

In one or more embodiments, at least one of the lid portion and body portion further comprises an air hole that can be opened and closed. The container assembly may further comprise an air hole closure member for opening and closing the air hole, the air hole closure member comprising a re-sealable strip of tape, a flip-top closure, or a valve mechanism. The body portion may further comprise a base and the base may comprise the air hole.

In one or more embodiments, a method of using a container assembly as described herein is provided, comprising providing a fluid at least partially filling the container assembly; placing the lid portion onto the body portion to create an enclosed volume containing the fluid and a region of gas above the fluid having a vapor pressure; allowing the vapor pressure to increase to or above a threshold pressure; and permitting excess vapor pressure to vent through the venting feature while retaining the lid portion on the body portion.

In one or more embodiments of the method, the lid portion and the body portion return to a sealing state after venting.

In one or more embodiments, a spray gun assembly is provided, comprising a container assembly as described herein; and a spray gun configured to receive the container assembly.

As used herein, the term "fluid" refers to all forms of flowable materials including liquids, gases, dispersions, emulsions, and free-flowing solids or powders. For example, fluids can include flowable materials that can be applied to a surface using a spray gun (whether or not they are intended to color the surface) including (without limitation) paints, primers, base coats, lacquers, varnishes and similar paint-like materials as well as other materials such as adhesives, sealers, fillers, putties, powder coatings, blasting powders, abrasive slurries, mold release agents and foundry dressings which may be applied in atomized or non-atomized form depending on the properties and/or the intended application of the material. Exemplary fluids can also include gaseous or vapor states of any of the foregoing, or the vapors produced by heating any of the foregoing.

As used herein, the term "elliptical" refers to all closed-curve forms, including ovular and circular curves, as well as variations of closed-curve forms that are not perfectly round.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the terms "comprises" and variations thereof do not have a limiting meaning where these terms appear in the accompanying description. Moreover, "a," "an," "the," "at least one," and "one or more" are used interchangeably herein.

Relative terms such as left, right, forward, rearward, top, bottom, side, upper, lower, horizontal, vertical, along, with respect to, and the like may be used herein and, if so, are from the perspective observed in the particular figure. These terms are used only to simplify the description, however, and not to limit the scope of the invention in any way.

The above summary is not intended to describe each embodiment or every implementation of the reservoirs and associated vent assemblies described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1A:
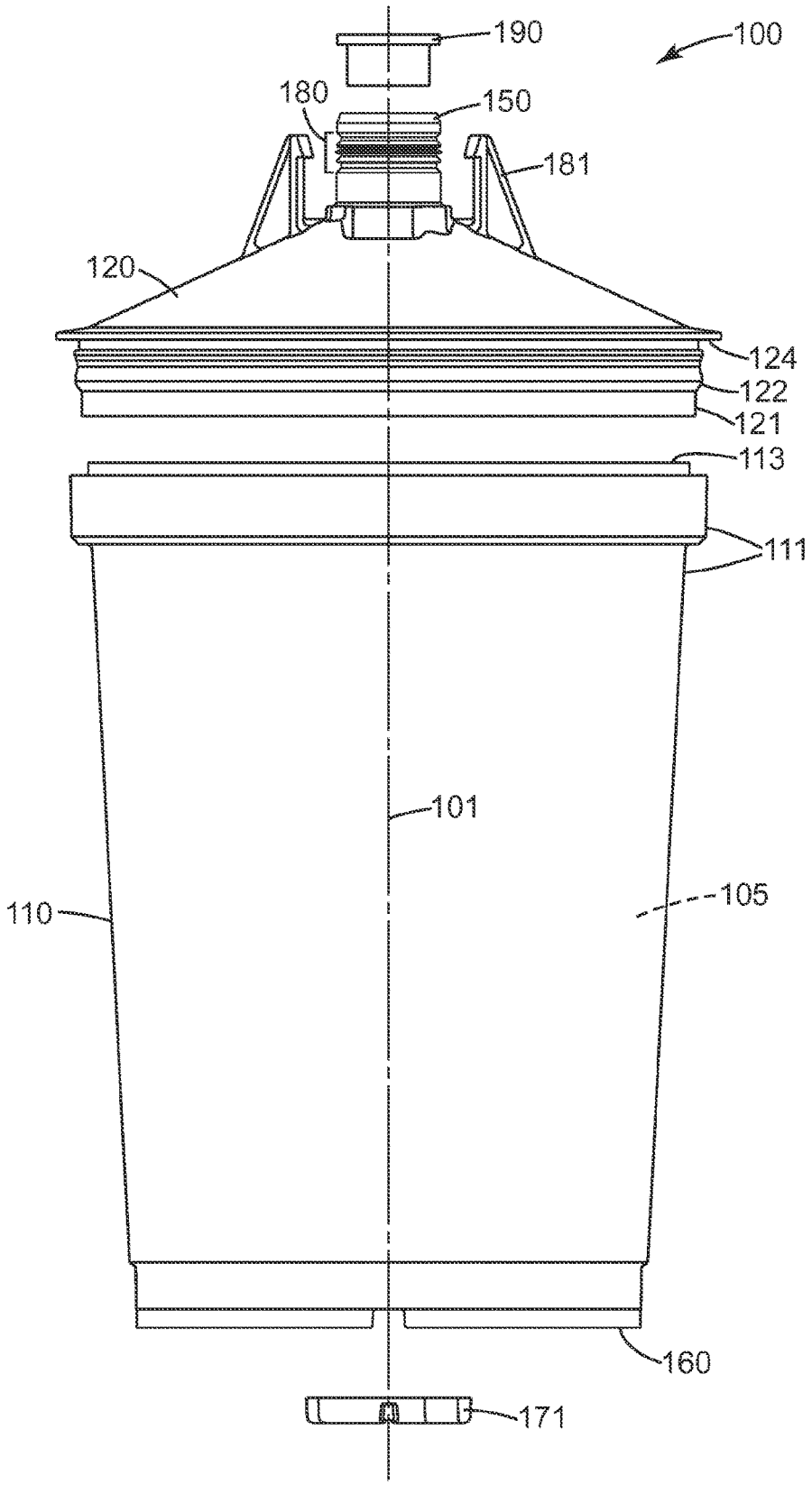
FIG. 1A is a perspective view of one illustrative embodiment of a container assembly as described herein in an exploded configuration.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

The container assemblies and reservoirs described herein may be used in a wide variety of environments in which a fluid, e.g. unused paint or other material, is provided in an enclosed volume and stored therein in a manner that requires adequate sealing to prevent drying or other undesirable alteration of the fluid and venting to avoid compromise of the seal that could cause drying or other undesirable alteration of the fluid. One example of such an environment is in a liquid spray delivery system in which a container assembly containing liquid to be dispensed is mountable on a liquid spray gun. When not in use, the container assembly can be sealed and stored for later use. When the fluid pressure inside the container assembly is less than a threshold pressure, container has a substantially fluid-tight seal against fluid leaving the enclosed volume. When the fluid pressure is greater than or equal to the threshold pressure, a venting feature allows the excess fluid pressure to vent from the enclosed volume while retaining the lid on the container assembly. Venting features described herein allow the container assemblies to be stored even in high temperature environments (e.g. greater than about 100° F.) without loss of lid retention and with effective sealing despite intermittent elevated internal fluid pressure inside the container assemblies.

Additionally, users of the container assemblies described herein may open the container assemblies during use, such as to add fluids to the container assemblies or clean out the container assemblies. Venting features herein also allow the container assemblies to be opened by, e.g., removing a lid portion from a body portion, with less pull force than similar container assemblies lacking such venting features. Venting features described herein allow lids on the container assemblies to be removed more easily and with less force, thus preventing user injuries, spills, and other hazards.

While containers assemblies can be constructed using threaded and non-threaded lid connections, the container assemblies described herein use non-threaded, e.g., snap-lid or push-lid, lid connections, thereby providing the ease of use of non-threaded lid connections while maintaining the lid in a retained venting state. Additionally, the container assemblies described herein avoid the disadvantages of containers having threaded lid connections, such as build up of pressure without venting, or compromise of seal for venting without re-sealing.

Figure 1B:
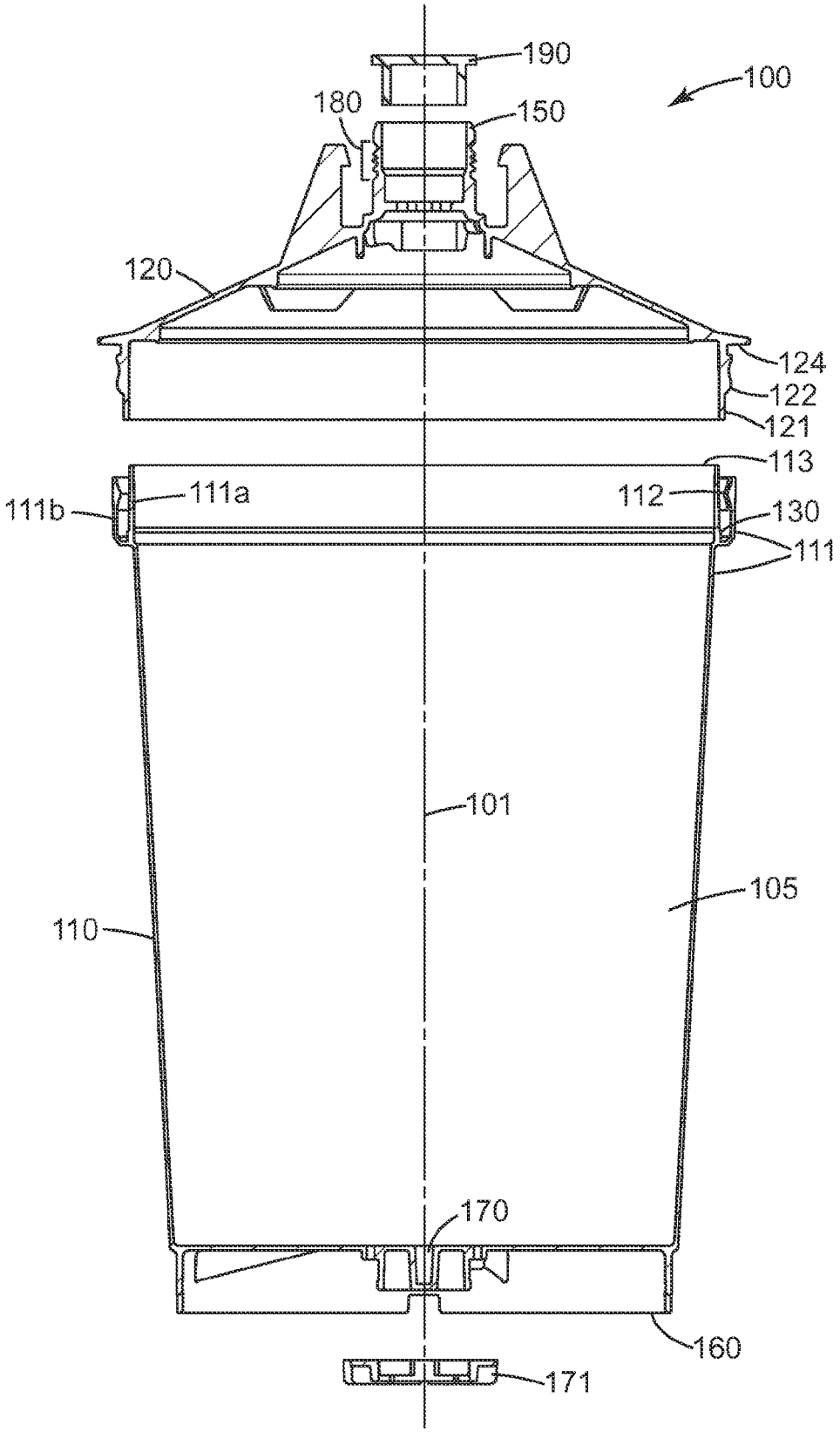
FIG. 1B is a cross-sectional view of the container assembly of FIG. 1A.
Figure 1C:
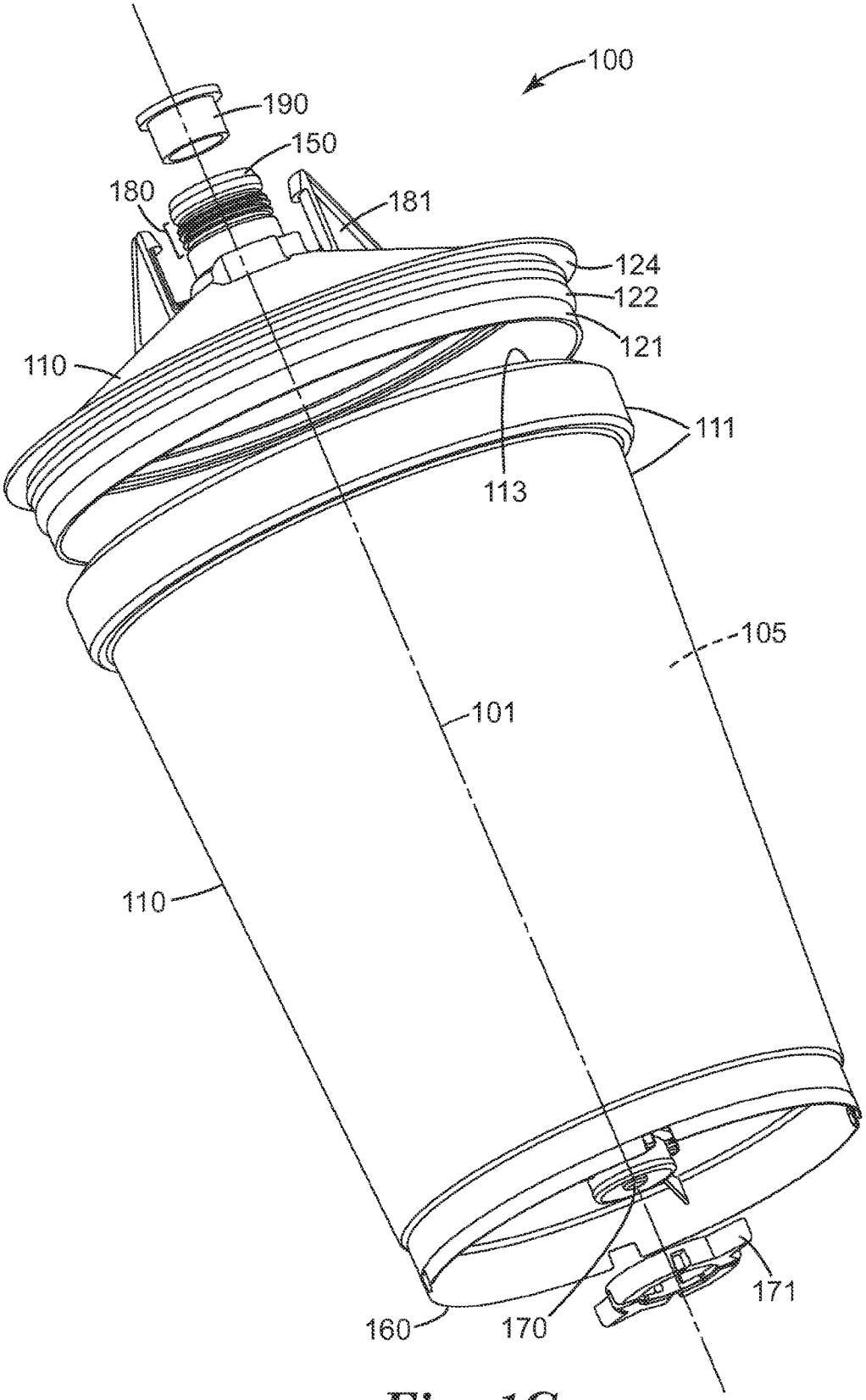
FIG. 1C is another perspective view of the container assembly of FIG. 1A.

One illustrative embodiment of a container assembly as described herein is depicted in connection with FIGS. 1A-1C. FIG. 1A depicts a side view of an open configuration of a container assembly 100, FIG. 1B depicts a cross section of the container assembly 100 of FIG. 1A, and FIG. 1C depicts another perspective view of the container assembly 100 of FIGS. 1A-1B. The container assembly 100 comprises a body portion 110 and a detachable lid portion 120. The body portion comprises a body portion sidewall 111, a first retainer 112 (not visible in FIG. 1A and FIG. 1C), an open end 113, and a base 160. In the depicted embodiment, the body portion also includes a protrusion 130 (not visible in FIG. 1A and FIG. 1C). While the protrusion 130 is depicted as disposed on the body portion 110 in this embodiment, as described herein, the protrusion may alternatively be disposed on the lid portion. The protrusion 130 may also be omitted.

The detachable lid portion 120 (which can be removed from the open end 113 of the body portion 110 so that, e.g., the container's enclosed volume 105 can be filled with a liquid through the open end 113) is adapted to cover, e.g. close, the open end 113 of the body portion 110 to form an enclosed volume 105, e.g. reservoir, when the lid portion 120 is attached to the body portion 110 over the open end 113. As can be appreciated from FIGS. 1A-1C, in the illustrative embodiment, the open end 113 of the body portion 110 of the container assembly 100 surrounds a container axis 101 and movement of the lid portion 120 from the sealing state to an open configuration is substantially along the container axis 101. The lid portion 120 comprises a lid portion sidewall 121 and a second retainer 122 disposed on the lid portion sidewall 121. The second retainer 122 is adapted to cooperate with the first retainer 112 to retain the lid portion 120 on the body portion 110. The lid portion 120 also includes an outlet 150, which may be sealed with outlet closure member 190, e.g. a plug, for sealing the outlet for storage purposes to create a sealed enclosed volume.

In some embodiments, the body portion sidewall 111 may optionally comprise a double sidewall such that at least a portion of the body portion sidewall 111 comprises two sidewalls 111*a* and 111*b* running substantially parallel to one another and/or at an angle to one another. In some embodiments, the lid portion sidewall 121 may optionally comprise a double sidewall such that at least a portion of the lid portion sidewall 121 comprises two sidewalls (not shown) running substantially parallel to one another and/or at an angle to one another. In some embodiments, both the body portion sidewall 111 and the lid portion sidewall 121 may comprise double sidewalls. In some such embodiments, an annulus is formed (i.e., between the two sidewalls) on at least one of the lid portion or the body portion into which the cooperating part can nest and connect. Such a configuration can provide benefits such as easier alignment of the lid portion and the body portion during assembly. As shown and described below with respect to FIG. 6, such a double sidewall construction can further enhance or modify cooperation between the lid and body portions by permitting the use of opposing forces to "trap" the parts together when assembled. For example, protrusion 130 on sidewall 111*a* can force lid portion sidewall 121 radially outwardly, while sidewall 111*b* can in turn force lid portion sidewall 121 radially inwardly, thus providing opposing forces to "trap" the lid portion and alter the manner in which the lid and body portions are sealed and retained with respect to one another. Of course, the opposite configuration may be constructed (i.e., an annulus on the lid portion), provided such configurations function according to the present disclosure.

The lid portion 120 (or any other suitable portion of the container 100) may, in one or more embodiments, include an outlet 150 or other structures, such as ports, etc., that may facilitate connection of the container 100 to, e.g., a spray gun 2 (shown in FIG. 7) for dispensing a liquid contained therein to the spray gun for application to a surface. The outlet and/or lid may include threads 180 or other attachment structures 181 to, e.g., assist in attachment of the container to a spray gun or other device. In some embodiments, the outlet 150 is independent of the structure, e.g. attachment structure 181, for retaining the container to a spray gun or other device.

The lid portion 120 may optionally include one or more extensions 124 to assist the user with placement and removal of the lid portion 120 to allow for opening and closing of the container assembly 100, e.g., by hand or with tools. It should, however, be understood that the lid portion 120 may be designed for removal using a tool designed for that function. Further, extensions 124 represent only one example of many different structures that could be used to facilitate removal of the lid portion 120.

The container assembly may optionally comprise an air hole 170 (not visible in FIG. 1A and FIG. 1B), and an air hole closure member 171 for opening and closing the air hole 170 in the container assembly 100. Such an air hole 170 can provide means for permitting air to enter the enclosed volume during spraying, e.g. to prevent formation of a vacuum, and can be closed during storage. While the air hole closure member may be attached to or mounted on the container assembly, it is shown detached in FIGS. 1A-1C for visual simplicity.

In the illustrative embodiment depicted in FIGS. 1A-1C, an air hole 170 and air hole closure member 171 are located in the base 160 of the container assembly 100. Although the air hole 170 and air hole closure member 171 in the illustrative embodiment depicted in FIGS. 1A-1C are located in the base 160, air hole and air hole closure members described herein could be located in any wall of the container 100 with the base 160 being only one example of a wall in which the air hole 170 and air hole closure member 171 could be located. For example, in one or more embodiments, the air hole 170 and air hole closure member 171 could be located in any wall forming a part of the container 100, including the body portion 110 or the lid portion 120. The air hole 170 and air hole closure member 171 may be in a location that is typically positioned above any liquid in the container 100 (relative to the force of gravity) when the container 100 is being used to dispense the liquid contained therein, or otherwise positioned or configured to permit air to enter the container while preventing leakage of liquid while spraying. Furthermore, although the container 100 includes only one air hole 170 and air hole closure member 171, in one or more embodiments, the container 100 could include two or more air holes and corresponding air hole closure members and those air holes and corresponding air hole closure members could be located in the same wall or in different walls of the container 100.

As described herein, air hole closure member 171 is movable between an open position and a closed position. The air hole closure member 171 is typically placed in the closed position when the enclosed volume 105 of the container 100 is being filled with a liquid through, e.g., the open end of the body portion or through the outlet in the lid, and during storage. In the embodiment shown, leakage of the liquid used to fill the enclosed volume 105 through the air hole closure member 171 is typically prevented when the liquid is located above the air hole closure member 171 by placing the air hole closure member 171 in the closed position.

The container assembly 100 may, in one or more embodiments, be inverted during use (when, e.g., attached to a spray gun 2, shown in FIG. 7) such that the base 160 and body portion 110 are located above the lid portion 120. That change in orientation may place the air hole closure member 171 above the liquid in the enclosed volume 105. Movement of the air hole closure member 171 from the closed position to the open position allows for entry of air into the volume of the enclosed volume 105 without allowing the liquid to leak through the air hole closure member 171.

In some embodiments, the air hole closure member 171 is configured for rotation about container axis 101. As discussed herein the air hole closure member 171 is configured for rotation about an axis such as the container axis 101 between a closed position and an open position. In some embodiments where the air hole closure member 171 rotates about an axis, the air hole closure member 171 or the body portion 110 may include stops or other means for limiting the rotation of the air hole closure member 171. In some embodiments, the air hole closure member 171 is a cap, e.g. a flip-top cap, that may be removed from a closed position to an open position by moving the air hole closure member 171 along the container axis 101. In other embodiments, the air hole closure member 171 could be an adhesive tape, a valve mechanism, or other closure mechanism known in the art, and may operate in any direction to allow the desired function. In some embodiments, the air hole 170 and/or air hole closure member 171 are passive, or automatically actuated, such that user intervention is not required for operation.

Where applicable, the depicted air hole closure member 171 may include extensions to assist the user in rotating or removing the air hole closure member 171 by hand. It should, however, be understood that the air hole closure member 171 may be designed for rotation or removal using a tool designed for that function. Further, extensions represent only one example of many different structures that could be used to facilitate manual rotation or removal of the air hole closure member 171.

The air hole closure member can be attached to the container assembly by means known in the art, including adhesive attachment as well as mechanical attachment. For example, some attachment methods and features are shown in U.S. Publication No. 2015/0203259, and U.S. Pat. No. 6,820,824, filed Jan. 14, 1998, both of which are hereby incorporated by reference in their entirety herein.

The container assembly 100, and/or any part of it, may be constructed of polymeric materials such as, e.g., polypropylene, polyethylene, combinations thereof, etc., although the container parts may be constructed of any material that is suitable for containing the liquid with which the container assembly 100 is to be used. In some embodiments, the body portion 110 and/or the lid portion 120 may be transparent, translucent, or opaque, and may optionally include markings, such as, e.g. volume measurements to permit users to measure fluids therein and/or to accurately mix multi-component fluids without the need of a separate measuring vessel.

Although in the depicted embodiment the open end 113 of the body portion 110 is elliptical in shape, e.g., circular, and the depicted embodiment of container 100 is generally cylindrical such that it includes a cylindrical body portion sidewall 111 and a base 160 (which is also a wall as the term "wall" is used herein), other container assemblies described herein may be used and may, for example, not include a base, may have only one wall, may have two, three or more walls, etc. Essentially, the container assemblies described herein may take any suitable shape that includes at least one wall that defines a volume in which liquid can be contained.

While the illustrative container assembly depicted in FIGS. 1A-1C comprises a venting feature, the venting feature is not visible in the perspectives shown in FIGS. 1A-1C. The venting feature of some illustrative embodiments of the container assemblies may be best seen in the enlarged views depicted in FIGS. 2-4.

Figure 2:
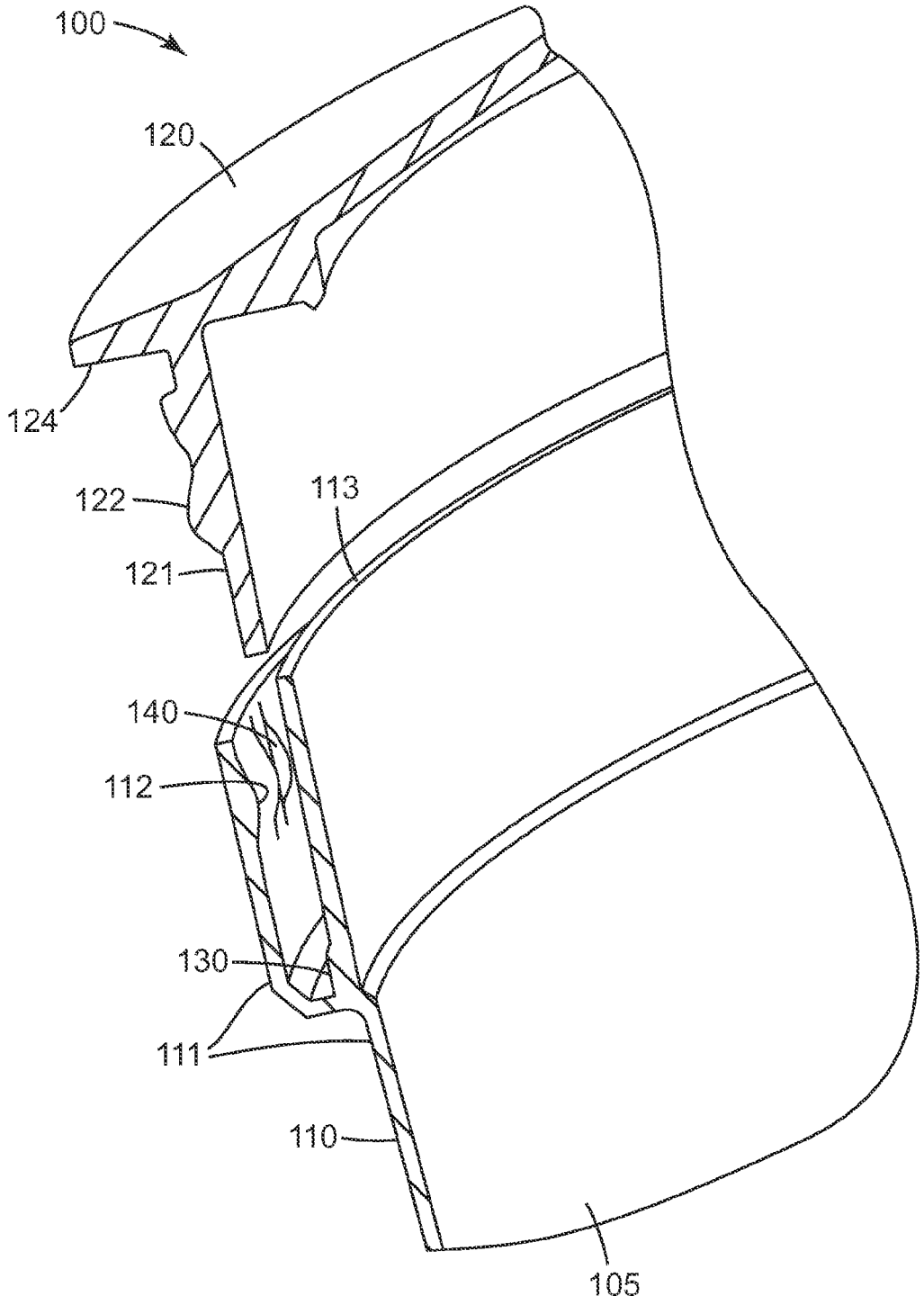
FIG. 2 is an enlarged cross-sectional perspective view of a portion of a container assembly as described herein in an open configuration.

FIG. 2 depicts an enlarged cross-sectional perspective view of an open configuration of the container assembly 100 comprising a body portion 110 and a lid portion 120. The body portion 110 comprises a body portion sidewall 111, a first retainer 112, and an open end 113. In the illustrative embodiment, the first retainer 112 is disposed proximate the open end 113 of the body portion 110. In other embodiments, the first retainer may be positioned away from the open end 113, for example, proximate a base 160.

In the embodiments shown, the lid portion 120 is adapted to cover the open end 113 of the body portion 110 to create an enclosed volume 105, e.g. reservoir. The lid portion 120 comprises a lid portion sidewall 121, a second retainer 122, and optional extensions 124 to assist the user with placement and removal of the lid portion 120 to allow for opening and closing of the container assembly 100. The second retainer 122 is generally adapted to bear against the first retainer 112 when the container is in a closed configuration.

In the illustrative embodiment, the body portion 110 additionally comprises a protrusion 130, which runs all the way around the perimeter, e.g., circumference of the body portion 110. Although the illustrative embodiment depicts the protrusion 130 on the body portion 110, in some embodiments, the protrusion 130 may be located on the lid portion 120 (and would therefore run all the way around the perimeter, e.g., circumference, of the lid portion 120), or more than one protrusion 130 may be located on the container 100, e.g., one protrusion 130 running the perimeter of the body portion 110 and one protrusion running the perimeter of the lid portion 120.

The first retainer 112 further comprises a venting feature 140. Although the illustrative embodiment depicts the venting feature 140 on the first retainer 112, the venting feature 140 may also be located on the second retainer 122, or on both the first retainer 112 and the second retainer 122. The venting feature 140 typically comprises one or more interruptions in the first retainer 112 or second retainer 122, such as notches or grooves.

Figure 3:
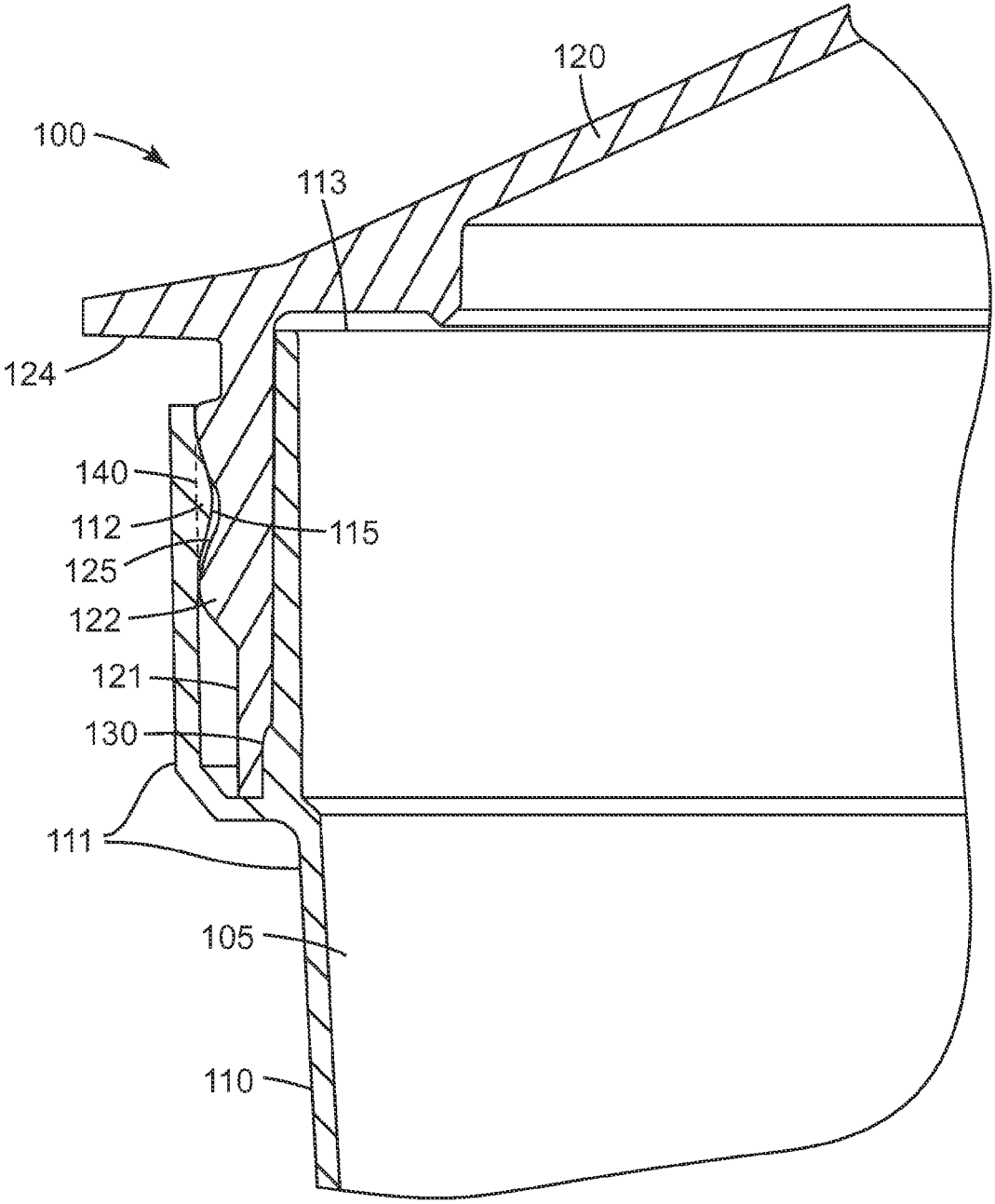
FIG. 3 is an enlarged cross-sectional view of a portion of a container assembly as described herein in a closed configuration.

FIG. 3 shows an enlarged cross-sectional view of a closed configuration of the container assembly 100 comprising a body portion 110 and a lid portion 120. The body portion 110 comprises a body portion sidewall 111, a first retainer 112, and an open end 113. In the illustrative embodiment, the first retainer 112 is disposed proximate the open end 113 of the body portion 110.

The lid portion 120 is adapted to cover the open end 113 of the body portion 110 to create an enclosed volume 105, e.g. reservoir. The lid portion 120 comprises a lid portion sidewall 121, a second retainer 122, and extensions 124 to assist the user with placement and removal of the lid portion 120 to allow for opening and closing of the container assembly 100. The second retainer 122 is generally adapted to bear against the first retainer 112 when the container is in a closed configuration.

Figure 6:
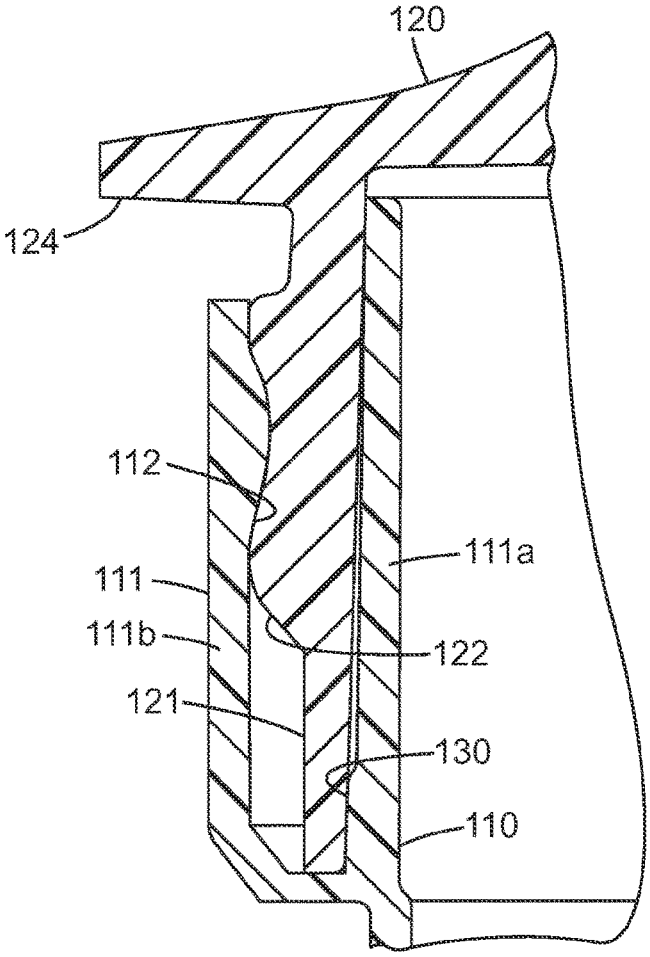
FIG. 6 is a detailed enlarged cross-sectional view of a portion of a container assembly as described herein in a closed configuration.

The body portion 110 may additionally comprise a protrusion 130, which runs all the way around the perimeter, e.g., circumference of the body portion 110. When the lid portion 120 is in a closed configuration with the body portion 110, as depicted in FIG. 3, a fluid-tight seal is formed by the body portion sidewall 111, the first retainer 112, the lid portion sidewall 121, the second retainer 122, the protrusion 130, or combinations thereof. While FIG. 3 shows interference between 130, 122, 112, and their respective cooperating features, in reality, the parts will typically deform in cooperation, as shown in FIG. 6.

The first retainer 112 further comprises a venting feature 140. In one embodiment, the first retainer 112 also includes a first retaining surface 115 disposed at a first angle 116 (shown in FIG. 5A) with respect to the body portion sidewall 111. The second retainer 122 comprises a second retaining surface 125 disposed at a second angle 126 (shown in FIG. 5A) with respect to the lid portion sidewall 121. In some embodiments, the second angle 126 may be complimentary to the first angle 116. In some embodiments, the first angle 116 may range from 1 degree to 90 degrees from the body portion sidewall 111. In some embodiments, the first angle 116 may range from 5 degrees to 80 degrees, 10 degrees to 60 degrees, 20 degrees to 45 degrees, including, for example, 25 degrees, 37 degrees, 52 degrees, etc. from the body portion sidewall 111. In some embodiments, the second angle 126 may range from 1 degree to 90 degrees from the lid portion sidewall 121. In some embodiments, the second angle 126 may range from 5 degrees to 80 degrees, 10 degrees to 60 degrees, 20 degrees to 45 degrees, including, for example, 25 degrees, 37 degrees, 52 degrees, etc. from the lid portion sidewall 121.

It is intended that when the fluid pressure inside the container assembly is less than a threshold pressure, the lid portion 120 is in a sealing state such that the lid portion 120 and the body portion 110 cooperate to maintain a substantially fluid-tight seal against fluid leaving the enclosed volume 105, e.g., reservoir. When the fluid pressure is greater than or equal to the threshold pressure, at least one of the lid portion 120 and the body portion 110 is transitions to a retained venting state such that excess fluid pressure from the enclosed volume 105, e.g. reservoir, vents through the venting feature 140 while retaining the lid portion 120 on the body portion 110. e.g., the container remains in a closed configuration. Additionally, it is intended that once the excess fluid pressure has vented from the container assembly 100, the lid portion 120 and body portion 110 will return to a configuration having a fluid-tight seal. In some embodiments, the venting feature 140 may be selective such that only species having certain viscosities, e.g. low viscosities, may escape the enclosed volume 105 while the container assembly 100 is in a retained venting state. For example, in some embodiments, venting of excess vapor pressure while the container assembly 100 is in the retained venting state includes venting of gases, such as air or air laden with water or solvent vapor, but not liquids, such as water or solvent-based paints. The venting feature 140 can be configured to selectively vent specific species while sealing against release of other species by choosing dimensions, e.g. length and width; shapes, e.g. straight, zigzag, curve; surface finishes, materials, e.g. selective membranes; all of which may comprise direct or tortuous paths appropriate for the particular dimensions and application of the container assembly 100 and for the fluids and gases desired to be respectively retained and/or vented for a given application.

In some embodiments, when the fluid pressure inside a closed container is greater than or equal to a threshold pressure, the lid portion 130 is configured such that the second retaining surface 125 is repositionable with respect to the first retaining surface 115. In some such embodiments, when the fluid pressure inside the closed container is greater than or equal to a threshold pressure, the second retaining surface 125 may move, e.g. translate, along the first retaining surface 115, as the lid portion 120 moves along the container axis (not shown in FIG. 3) from the sealed state to a retained venting state to allow venting of the excess fluid pressure through the venting feature 140. In other embodiments, the second retaining surface 125 may deform with respect to the first retaining surface 115, thus allowing venting of the excess fluid pressure through the venting feature 140.

In some embodiments, when the fluid pressure inside a closed container is greater than or equal to a threshold pressure, the lid portion sidewall 121 is repositionable such that the excess fluid pressure vents through the venting feature 140. In such embodiments, the lid portion sidewall 121 moves or deforms with respect to the body portion sidewall 111.

In some embodiments, when the fluid pressure inside a closed container is greater than or equal to a threshold pressure, the lid portion sidewall 121 is repositionable and the second retaining surface 125 is repositionable with respect to the first retaining surface 115 such that excess fluid pressure vents through the venting feature 140. In such embodiments, the second retaining surface 125 may move, e.g. translate, along the first retaining surface 115, or may deform with respect to the first retaining surface 115, and the lid portion sidewall 121 may move or deform with respect to the body portion sidewall 111.

In some embodiments, such as where the venting feature is a hole through the body portion sidewall 111 and/or the lid portion sidewall 121, when the fluid pressure inside a closed container is greater than or equal to a threshold pressure, the body portion sidewall 111 and/or the lid portion sidewall 121 flexes or deforms such that excess fluid pressure vents through the venting feature 140.

In some embodiments, excess pressure may vent through outlet closure member 190, either as the sole vent in the container assembly, or in combination with venting feature 140. In some embodiments, the features of body portion 110 and lid portion 120, such as venting feature 140, first retaining surface 112, second retaining surface 122, etc. may be adapted for use on the outlet 150 and outlet closure member 190 (e.g. outlet 150 has the features of and performs like body portion 110 and outlet closure member 190 has the features of and performs like lid portion 120). In some embodiments, outlet closure member 190 may comprise a porous material, such as expanded polytetrafluoroethylene, that allows venting and/or influx of gases and excess pressure while selectively preventing the flow of liquid or other non-gaseous medium through closure member 190.

In some embodiments, the threshold vapor pressure depends on the size, e.g. volume, diameter, etc., of the container assembly, the composition of the container assembly, and/or the fluid contained within the enclosed volume 105. In some embodiments, the threshold vapor pressure also depends on the conditions, e.g. temperature, altitude, etc. to which the container assembly is exposed. For example, in some embodiments, the venting feature can be tailored to operate at a threshold vapor pressure based on the temperature at which the container assembly will store fluid and the type of fluid stored. Exemplary temperatures to which the container assemblies may be exposed and/or at which the vapor pressure inside container assemblies reach threshold vapor pressures include temperatures ranging from 0° F. to 200° F. In some embodiments, the vapor pressure inside container assemblies may reach threshold vapor pressures at temperatures ranging from 40° F. to 120° F., 90° F. to 110° F., etc.

Figure 4:
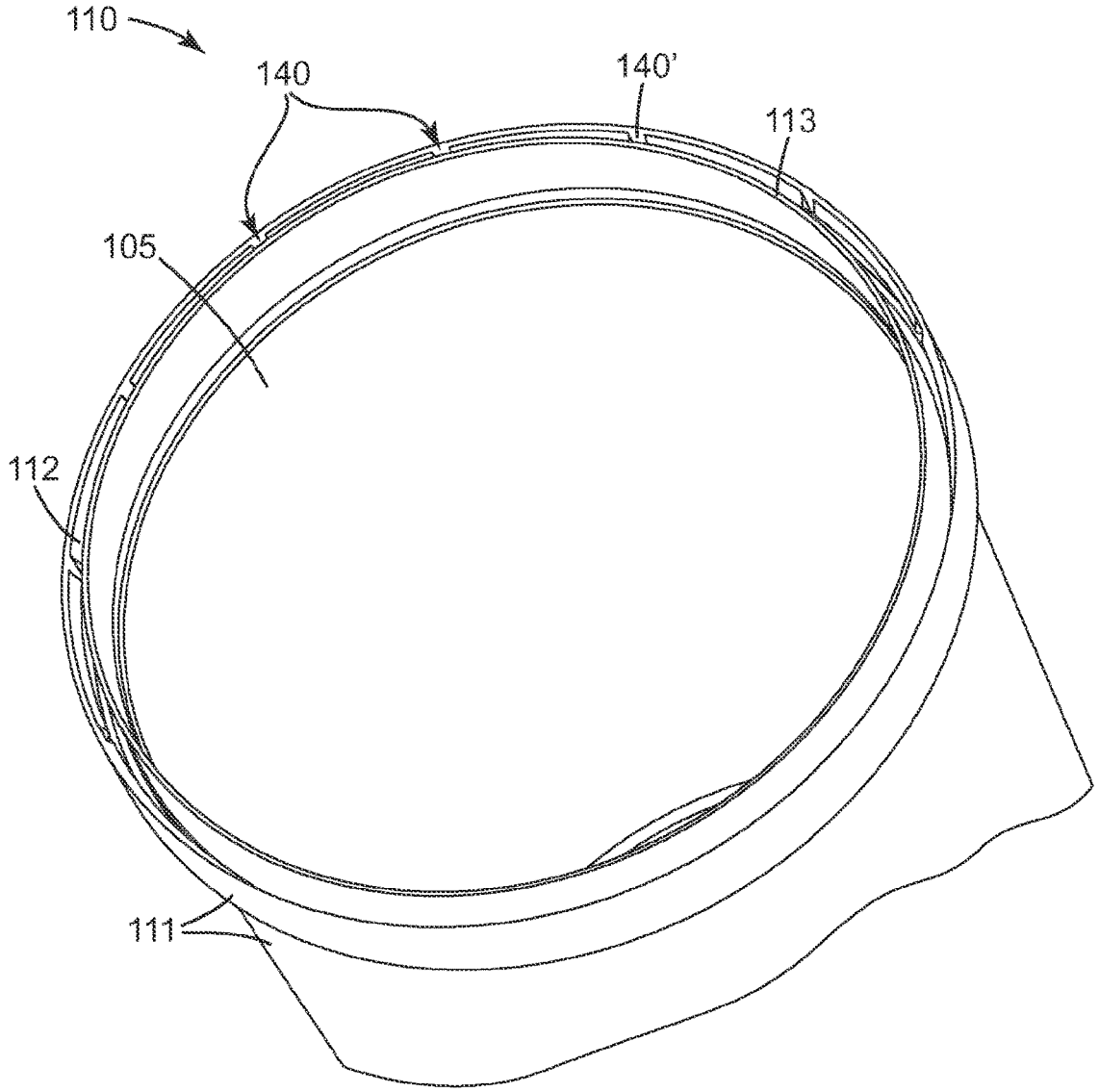
FIG. 4 is an enlarged perspective view of the body portion a container assembly as described herein.

FIG. 4 shows an enlarged perspective view of a body portion 110 of a container assembly. The body portion 110 comprises a body portion sidewall 111, a first retainer 112, and an open end 113. In the illustrative embodiment, the first retainer 112 is disposed proximate the open end 113 of the body portion 110. The first retainer 112 further comprises a venting feature 140 comprising a plurality of venting members 140'. The first retainer 112, and if present on the first retainer 112, the venting member(s) 140', may extend all the way to the open end 113 of the body portion 110, or may extend only to a location proximate the open end 113 of the body portion 110. In some embodiments, a venting member 140' can extend through the body portion sidewall, such as in embodiments where a venting member 140' comprises one or more apertures in the body portion sidewall.

Although the illustrative embodiment depicts the venting feature 140 on the first retainer 112, the venting feature 140 may also be located on the second retainer, or on both the first retainer 112 and the second retainer 122. The venting feature 140 is typically one or more interruptions, e.g. one or more venting members 140', in the first retainer 112 or second retainer 122, such as notches, grooves, indentations, incisions, holes or apertures through the body portion sidewall and/or lid portion sidewall, textured surface, porous material, or any other shape or material that permits gas to escape when the lid portion 120 is in the retained venting state. The one or more interruptions, e.g. venting members 140', may be substantially straight, e.g. parallel or perpendicular with the container axis 101 in all planes, or may take on any geometric configuration such as a curve or zigzag, e.g., running parallel with the container axis in one plane, while running at one or more angles to the container axis in one or more other planes. The number of interruptions, e.g. venting members 140', depends on the particular container assembly, including, for example, the size of the container assembly, the flexibility of the various portions of the container assembly, and the intended application, e.g. expected vapor pressures inside the enclosed volume 105 or expected user strength when opening the container assembly. In some embodiments, the venting feature 140 comprises a sufficient number of interruptions, e.g. venting members 140', to reduce the area in contact between the lid portion 120 and the body portion 110 of the container assembly 100, and/or increase the flexibility of the body portion 110 and/or the lid portion 120.

In some embodiments, the venting feature 140 comprises a plurality of venting members 140', e.g. notches, grooves, etc. which may be spaced unevenly or substantially evenly about the first retainer, second retainer, or combinations thereof. Where the open end 113 of the body portion 110 is elliptical in shape, e.g., circular, and comprises an open end circumference, the plurality of venting members 140' may be spaced unevenly or in a substantially equidistant manner around the open end circumference. In some embodiments, the venting feature 140 comprises an adequate number of interruptions, e.g. venting members 140', to accomplish venting of excess vapor pressure, decrease the force required to remove the lid portion 120 from the body portion 110 to convert the container assembly 100 from a closed configuration to an open configuration as compared to a similar container assembly lacking the venting feature 140, and/or provide a sufficient seal when the container assembly 100 is in the closed configuration to support the weight of the fluid contained within the enclosed volume 105. In such embodiments, an advantageous balance can be reached whereby, on the one hand, a user can relatively easily assemble and disassemble the lid and body portions, yet the enclosed volume is permitted to vent with the attachment between the lid and body portions being robust enough to prevent disconnection during pressurization of the enclosed volume. It is envisioned that such criteria can be balanced according to the present disclosure to achieve desirable operation for a variety of users and applications.

In some embodiments, first retaining surface 112, second retaining surface 122, body portion sidewall 110, lid portion sidewall 120, venting feature 140, and/or venting members 140' may comprise a porous material, such as expanded polytetrafluoroethylene, that allows venting and/or influx of gases and excess pressure while selectively preventing the flow of liquid or other non-gaseous medium through the porous material.

Figure 5:
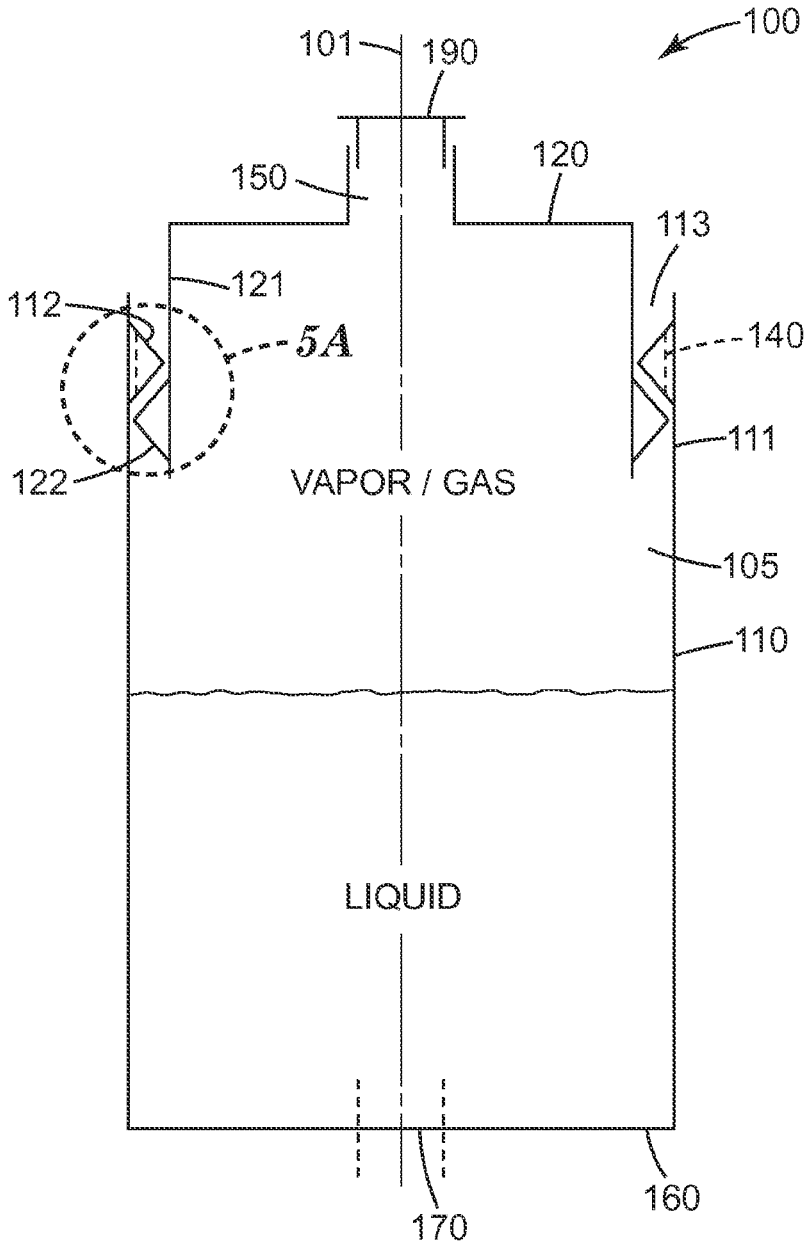
FIG. 5 is a cross-sectional schematic view of one illustrative embodiment of a container assembly as described herein in a closed configuration.

FIG. 5 shows a cross-sectional schematic view of one illustrative embodiment of a container assembly 100 comprising a body portion 110 and a detachable lid portion 120. The body portion comprises a body portion sidewall 111, a first retainer 112, an open end 113, and a base 160. In the illustrative embodiment, the first retainer 112 further comprises a venting feature 140, typically comprising one or more interruptions in the first retainer 112 (or, in other embodiments, the second retainer 122), such as notches, grooves, apertures, etc.

The detachable lid portion 120 is adapted to cover, e.g. close, the open end 113 of the body portion 110 to form an enclosed volume 105, e.g. reservoir, when the lid portion 120 is attached to the body portion 110 over the open end 113. The enclosed volume 105 can contain a stored liquid, as well as vapor and/or gas. In the illustrative embodiment, the open end 113 of the body portion 110 of the container assembly 100 surrounds a container axis 101 and movement of the lid portion 120 from the sealing state to an open configuration is substantially along the container axis 101. The lid portion 120 comprises a lid portion sidewall 121 and a second retainer 122 disposed on the lid portion sidewall 121. The second retainer 122 is adapted to cooperate with the first retainer 112 to retain the lid portion 120 on the body portion 110. The second retainer 122 is generally adapted to bear against the first retainer 112 when the container is in a closed configuration. In the depicted embodiment, the lid portion 120 also includes an outlet 150, and an outlet closure member 190 for sealing the outlet to create a sealed enclosed volume 105.

Figure 5A:
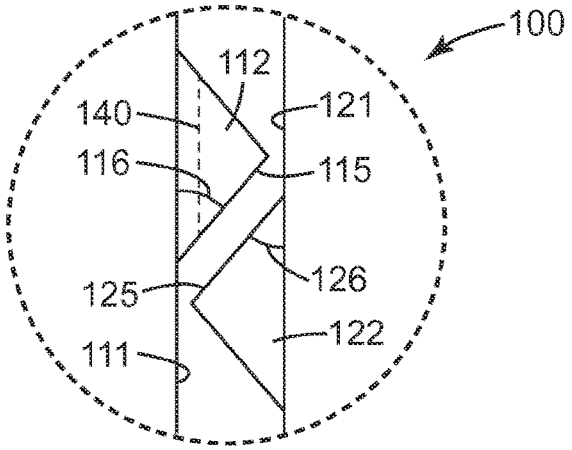
FIG. 5A is a detailed enlarged schematic view of a portion of the container assembly in a closed configuration taken at 5A of FIG. 5.

FIG. 5A shows a detailed enlarged schematic view of a portion of the container assembly 100 in a closed configuration taken at 5A of FIG. 5. The container assembly 100 comprises a body portion sidewall 111, a first retainer 112, a lid portion sidewall 121, and a second retainer 122. The second retainer 122 is generally adapted to bear against the first retainer 112 when the container is in a closed configuration. In the illustrative embodiment, the first retainer 112 further comprises a venting feature 140. In the illustrated embodiment, the first retainer 112 also includes a first retaining surface 115 disposed at a first angle 116 with respect to the body portion sidewall 111. The second retainer 122 comprises a second retaining surface 125 disposed at a second angle 126 with respect to the lid portion sidewall 121.

The container assembly may optionally comprise an air hole 170 and an air hole closure member 171 (not shown in FIG. 5) for opening and closing the air hole 170 in the container assembly 100.

FIG. 6 shows a detailed enlarged cross-sectional view of a portion of a container assembly 100 comprising a body portion 110 and a lid portion 120. The body portion 110 comprises a body portion sidewall 111, a first retainer 112, and a protrusion 130.

The lid portion 120 comprises a lid portion sidewall 121, a second retainer 122, and extensions 124 to assist the user with placement and removal of the lid portion 120 to allow for opening and closing of the container assembly 100. The second retainer 122 is generally adapted to bear against the first retainer 112 when the container is in a closed configuration. In the illustrative embodiment, the body portion 110 additionally comprises a protrusion 130.

When the lid portion 120 is in a closed configuration with the body portion 110, as depicted in FIG. 6, a fluid-tight seal is formed by the body portion sidewall 111, the first retainer 112, the lid portion sidewall 121, the second retainer 122, the protrusion 130, or combinations thereof. FIG. 6 shows deformation of the lid portion sidewall 121 in cooperation with the protrusion 130 when the container is in a closed configuration.

Figure 7:
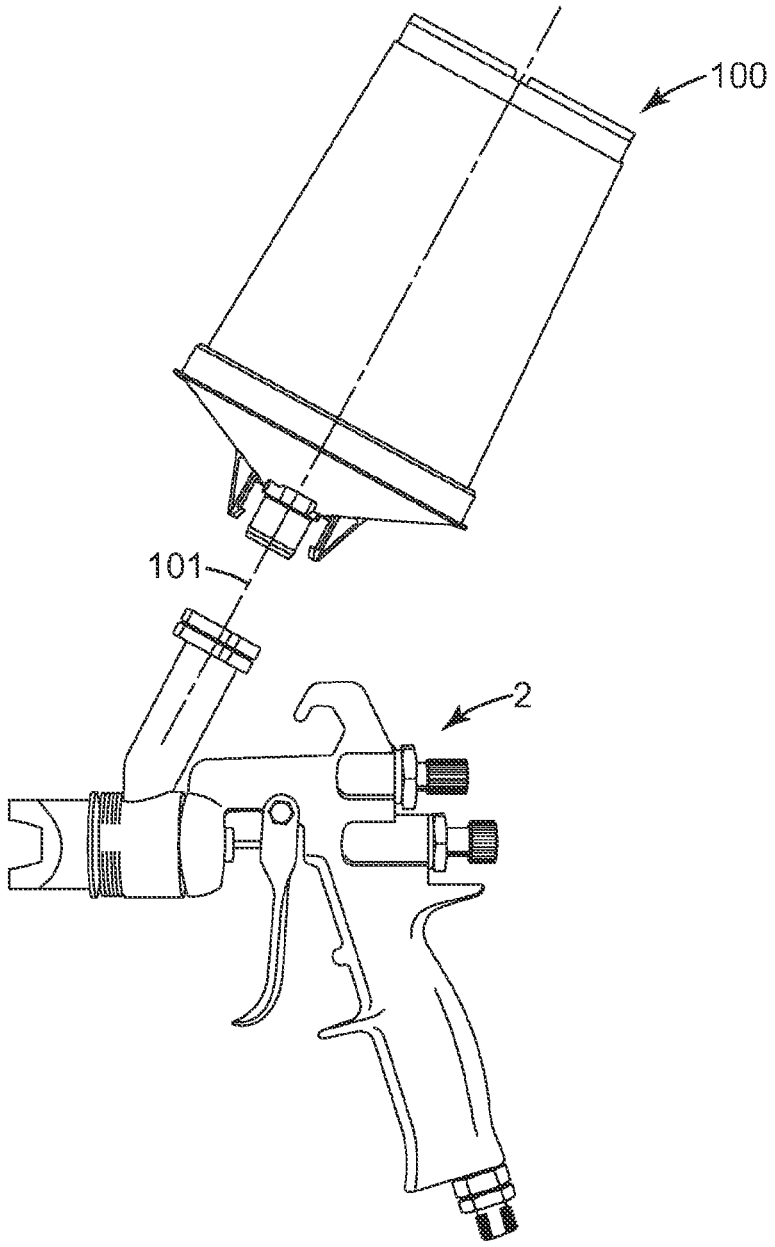
FIG. 7 is a schematic view of a spray gun assembly with a container assembly as described herein, shown in an exploded configuration.

As described herein, in some embodiments, a spray gun assembly is provided, comprising a container assembly as described herein, and a spray gun configured to receive the container assembly. FIG. 7 shows a schematic view of a spray gun assembly 2 with a container assembly 100 as described herein, in an exploded configuration. In one embodiment, spray gun 2 is adapted to receive container assembly 100 along the container axis 101. In the illustrative embodiment, the container assembly 100 may be attached to the spray gun by any attachment means known in the art.

In one or more embodiments, it may be preferred that all of the features depicted in FIGS. 1A-7 be molded of the same material, e.g., a thermoplastic such as polypropylene, polyethylene, and combinations thereof. Such a construction is not, however, required and one or more of the different features may be constructed of different materials that are joined or connected together by any suitable technique or combination of techniques. Additionally, the material selected to construct the lid portion 120 may preferably exhibit a higher or lower level of rigidity as compared to the materials used to construct the body portion 110 and its associated features. For example, in one illustrative embodiment, the lid portion 120 may be manufactured of, e.g., nylon, glass-filled nylon, etc. Although the lid portion 120 and the body portion 110 may each be molded or otherwise constructed of a single material, in one or more embodiments the lid portion 120 and the body portion 110 may each be constructed of multiple different materials. For example, the first retainer 112, second retainer 122, and protrusion 130 may be provided of a material that enhances sealing of the container assembly when the lid portion 120 and the body portion 110 are in a closed configuration.

Methods of using the container assemblies described herein are also provided, comprising providing a fluid at least partially filling the container assembly; placing the lid portion onto the body portion to create an enclosed volume containing the fluid and a region of gas above the fluid having a vapor pressure; allowing the vapor pressure to increase to or above a threshold pressure; and permitting excess vapor pressure to vent through the venting feature while retaining the lid portion on the body portion. In some embodiments, the lid portion and the body portion return to a sealing state after venting.

The following embodiments are intended to be illustrative of the present disclosure and not limiting.

Embodiment 1 is a container assembly comprising a body portion comprising an open end;

a body portion sidewall; and a first retainer disposed on the body portion sidewall;

a lid portion adapted to cover the open end of the body portion to create an enclosed volume, the lid portion comprising a lid portion sidewall; and a second retainer disposed on the lid portion sidewall and adapted to cooperate with the first retainer to retain the lid portion on the body portion;

wherein at least one of the first retainer and the second retainer comprises a venting feature;

wherein when the fluid pressure within the enclosed volume is less than a threshold pressure, at least one of the body portion and the lid portion is in a sealing state such that the lid portion and the body portion cooperate to maintain a substantially fluid-tight seal against a fluid leaving the enclosed volume; and wherein when the fluid pressure is greater than or equal to the threshold pressure, at least one of the lid portion and the body portion is in a retained venting state such that excess fluid pressure from the enclosed volume vents through the venting feature while retaining the lid portion on the body portion.

Embodiment 2 is the container assembly of embodiment 1, further comprising a protrusion disposed on at least one of the body portion and the lid portion.

Embodiment 3 is the container assembly of any one of the preceding embodiments, wherein the fluid-tight seal is formed by cooperation between at least two of the body portion sidewall, the first retainer, the lid portion sidewall, the second retainer, and the protrusion.

Embodiment 4 is the container assembly of any one of the preceding claims, wherein the second retainer is adapted to bear against the first retainer.

Embodiment 5 is the container assembly of any one of the preceding embodiments, wherein the venting feature comprises at least one interruption in the first retainer, the second retainer, or a combination thereof.

Embodiment 6 is the container assembly of any one of the preceding embodiments, wherein the first retainer is disposed proximate the open end of the body portion.

Embodiment 7 is the container assembly of any one of the preceding embodiments, wherein the open end of the body portion surrounds a container axis, and wherein movement of the lid portion from the closed position to the open position is along the container axis.

Embodiment 8 is the container assembly of any one of the preceding embodiments, wherein the first retainer comprises a first retaining surface and the first retaining surface is disposed at a first angle with respect to the body portion sidewall.

Embodiment 9 is the container assembly of embodiment 8, wherein the second retainer comprises a second retaining surface and the second retaining surface is disposed at a second angle with respect to the lid portion sidewall.

Embodiment 10 is the container assembly of embodiment 8, wherein the first angle is in a range from 1 degree to 90 degrees from the body portion sidewall.

Embodiment 11 is the container assembly of embodiment 9, wherein when the fluid pressure is greater than or equal to the threshold pressure, the second retaining surface is repositionable with respect to the first retaining surface.

Embodiment 12 is the container assembly of any one of the preceding embodiments, wherein when the fluid pressure is greater than or equal to the threshold pressure, the lid portion sidewall is repositionable with respect to the body portion sidewall.

Embodiment 13 is the container assembly of any one of the preceding embodiments, wherein the venting feature comprises a porous material.

Embodiment 14 is the container assembly of any one of the preceding embodiments, wherein the venting feature comprises a plurality of venting members.

Embodiment 15 is the container assembly of embodiment 14, wherein the plurality of venting members comprise notches, grooves indentations, incisions, holes, apertures, textured surfaces, porous materials, or combinations thereof.

Embodiment 16 is the container assembly of any one of embodiments 14 or 15, wherein the plurality of venting members are spaced substantially evenly about the first retainer, second retainer, or combinations thereof.

Embodiment 17 is the container assembly of any one of the preceding embodiments, wherein the open end of the body portion is elliptical and comprises an open end circumference.

Embodiment 18 is the container assembly of embodiment 17, wherein the plurality of venting members are spaced in a substantially equidistant manner around the open end circumference.

Embodiment 19 is the container assembly of any one of the preceding embodiments, wherein the body portion comprises a plastic material.

Embodiment 20 is the container assembly of any one of the preceding embodiments, wherein the lid portion has an outlet for transferring fluid contained in the enclosed volume out of the container assembly.

Embodiment 21 is the container assembly of embodiment 20, wherein the lid portion comprises an outlet closure member for sealing the outlet.

Embodiment 22 is the container assembly of embodiment 21, wherein the outlet closure member comprises a porous material.

Embodiment 23 is the container assembly of any one of the preceding embodiments, wherein at least one of the lid portion and body portion further comprises an air hole that can be opened and closed.

Embodiment 24 is the container assembly of embodiment 23, further comprising an air hole closure member for opening and closing the air hole, the air hole closure member comprising a re-sealable strip of tape, a flip-top closure, or a valve mechanism.

Embodiment 25 is the container assembly of any one of embodiments 23 or 24, wherein the body portion further comprises a base and the base comprises the air hole.

Embodiment 26 is a method of using a container assembly according to any one of embodiments 1-25, comprising:

providing a fluid at least partially filling the container assembly;

placing the lid portion onto the body portion to create an enclosed volume containing the fluid and a region of gas above the fluid having a vapor pressure;

allowing the vapor pressure to increase to or above a threshold pressure; and permitting excess vapor pressure to vent through the venting feature while retaining the lid portion on the body portion.

Embodiment 27 is the method of embodiment 26 wherein the lid portion and the body portion return to a sealing state after venting.

Embodiment 28 is a spray gun assembly comprising:

a container assembly according to any one of embodiments 1-25; and a spray gun configured to receive the container assembly.

Illustrative embodiments of the container assemblies, spray gun assemblies, and methods are discussed and reference has been made to some possible variations. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

What is claimed is:

1. A container assembly comprising a body portion comprising
- an open end;
- a body portion sidewall; and
- a first retainer disposed on the body portion sidewall;

a lid portion adapted to cover the open end of the body portion to create an enclosed volume,
- the lid portion comprising
- a lid portion sidewall;
- a second retainer disposed on the lid portion sidewall and adapted to cooperate with the first retainer to retain the lid portion on the body portion; and
- a structure to facilitate connection of the container assembly to a spray gun;

wherein at least one of the first retainer and the second retainer comprises a venting feature comprising at least one interruption in the first retainer, the second retainer, or a combination thereof;

wherein when the fluid pressure within the enclosed volume is less than a threshold pressure, at least one of the body portion and the lid portion is in a sealing state such that the lid portion and the body portion cooperate to maintain a substantially fluid-tight seal against a fluid leaving the enclosed volume; and wherein when the fluid pressure is greater than or equal to the threshold pressure, at least one of the lid portion and the body portion is in a retained venting state such that excess fluid pressure from the enclosed volume vents through the venting feature while retaining the lid portion on the body portion.

2. The container assembly of claim 1, further comprising a protrusion disposed on at least one of the body portion and the lid portion.

3. The container assembly of claim 1, wherein the fluid-tight seal is formed by cooperation between at least two of the body portion sidewall, the first retainer, the lid portion sidewall, the second retainer, and the protrusion.

4. The container assembly of claim 1, wherein the second retainer is adapted to bear against the first retainer.

5. The container assembly of claim 1, wherein the first retainer is disposed proximate the open end of the body portion.

6. The container assembly of claim 1, wherein the open end of the body portion surrounds a container axis, and wherein movement of the lid portion from a closed position to an open position is along the container axis.

7. The container assembly of claim 1, wherein the first retainer comprises a first retaining surface and the first retaining surface is disposed at a first angle with respect to the body portion sidewall.

8. The container assembly of claim 7, wherein the second retainer comprises a second retaining surface and the second retaining surface is disposed at a second angle with respect to the lid portion sidewall.

9. The container assembly of claim 8, wherein when the fluid pressure is greater than or equal to the threshold pressure, the second retaining surface is repositionable with respect to the first retaining surface.

10. The container assembly of claim 1, wherein when the fluid pressure is greater than or equal to the threshold pressure, the lid portion sidewall is repositionable with respect to the body portion sidewall.

11. The container assembly of claim 1, wherein the venting feature comprises a plurality of venting members.

12. The container assembly of claim 1, wherein the lid portion has an outlet for transferring fluid contained in the enclosed volume out of the container assembly.

13. The container assembly of claim 12, wherein the lid portion comprises an outlet closure member for sealing the outlet.

14. The container assembly of claim 13, wherein the outlet closure member comprises a porous material.

15. The container assembly of claim 1, wherein at least one of the lid portion and body portion further comprises an air hole that can be opened and closed.

16. The container assembly of claim 15, further comprising an air hole closure member for opening and closing the air hole, the air hole closure member comprising a re-sealable strip of tape, a flip-top closure, or a valve mechanism.

17. The container assembly of claim 1 wherein the enclosed volume contains a fluid comprising a flowable material for application to a surface using a spray gun.

18. The container assembly of claim 1 wherein both the sealing state and the retained venting state can be realized when the lid portion is assembled to the body portion after the lid portion has been previously disassembled and reassembled to the body portion.

19. A spray gun assembly comprising:

a container assembly according to claim 1; and a spray gun configured to receive the container assembly.

20. A method of using a container assembly according to claim 1, comprising:

providing a fluid at least partially filling the container assembly;

placing the lid portion onto the body portion to create an enclosed volume containing the fluid and a region of gas above the fluid having a vapor pressure;

allowing the vapor pressure to increase to or above the threshold pressure; and permitting excess vapor pressure to vent through the venting feature while retaining the lid portion on the body portion.

21. The method of claim 20 wherein the lid portion and the body portion return to the sealing state after venting.

22. The method of claim 20 comprising, after placing the lid portion onto the body portion to create an enclosed volume:

detaching the lid portion from the body portion; followed by placing the lid portion onto the body portion into the a sealing state.

23. The method of claim 20 comprising attaching the container assembly to a spray gun.

* * * * *